US005423520A

United States Patent [19]

Anderson et al.

[11] Patent Number: 5,423,520

[45] Date of Patent: Jun. 13, 1995

[54] IN-SITU CONTROL SYSTEM FOR ATOMIZATION

[75] Inventors: Iver E. Anderson, Ames, Iowa; Richard S. Figliola, Central, S.C.; Robert L. Terpstra, Ames, Iowa

[73] Assignee: Iowa State University Research Foundation, Inc., Ames, Iowa

[21] Appl. No.: 58,767

[22] Filed: Apr. 13, 1993

[51] Int. Cl.[6] ..... B22D 41/58

[52] U.S. Cl. ..... 266/99; 266/202; 222/603

[58] Field of Search ..... 266/236, 202, 78, 80, 266/99, 100; 222/603

[56] References Cited

U.S. PATENT DOCUMENTS

| | | | |
|---|---|---|---|
| 2,997,245 | 8/1961 | Nilsson et al. | 241/1 |
| 3,067,956 | 12/1962 | Tove | 241/1 |
| 3,302,892 | 2/1967 | Nilsson | 239/594 |
| 3,834,629 | 9/1974 | Hellan et al. | 239/8 |
| 4,619,845 | 10/1986 | Ayers et al. | 427/422 |
| 5,125,574 | 6/1992 | Anderson et al. | 239/8 |
| 5,176,874 | 1/1993 | Mourer et al. | 266/202 |

OTHER PUBLICATIONS

"Fundamentals of High Pressure Gas Atomization Process Control" in Advances in Powder Metallurgy Dec. 1991, vol. 5, pp. 1–12; Anderson and Figliola.

"Flow mechanisms in high pressure gas atomization", Mat. Sci. Eng. A148 (Dec. 1991), pp. 101–114; Anderson, Figliola and Morton.

"Fluid Flow Effects in Gas Atomization Processing", 22 pages, Anderson, Morton and Figliola Oct. 1989.

"Observations of Gas Atomization Process Dynamics", in Modern Developments in Powder Metallurgy, MPI-F-APMI, vol. 20, p. 205 (Dec. 1988); Anderson and Figliola.

"Ultrasonic Gas Atomisation", MPR Apr. 1986, pp. 255–260.

"Flow Measurements in Gas Atomization Processes", in Synthesis and Analysis in Materials Processing: Characterization and Diagnostics of Ceramics and Metal Particulate Processing; pp. 39–47 (Dec. 1989); Figliola, Anderson and Morton.

"Rapid Solidification of a Modified 7075 Aluminum Alloy by Ultrasonic Gas Atomization", pp. 273–286; Anand, Kaufman and Grant Dec. 1990.

*Primary Examiner*—Scott Kastler

*Attorney, Agent, or Firm*—Edward J. Timmer

[57] ABSTRACT

Melt atomizing apparatus comprising a melt supply orifice for supplying the melt for atomization and gas supply orifices proximate the melt supply orifice for supplying atomizing gas to atomize the melt as an atomization spray. The apparatus includes a sensor, such as an optical and/or audio sensor, for providing atomization spray data, and a control unit responsive to the sensed atomization spray data for controlling at least one of the atomizing gas pressure and an actuator to adjust the relative position of the gas supply orifice and melt supply in a manner to achieve a desired atomization spray.

14 Claims, 3 Drawing Sheets

$r_2 - r_0 = 2.5(r_1 - r_0)$

IN-SITU CONTROL SYSTEM FOR ATOMIZATION

CONTRACTUAL ORIGIN OF THE INVENTION

The United States Government has rights in this invention pursuant to Contract No. W-7405-ENG-82 between the U.S. Department of Energy and Iowa State University, Ames, Iowa, which contract grants to the Iowa State University Research Foundation, Inc. the right to apply for this patent.

FIELD OF THE INVENTION

The present invention relates to an atomization apparatus and atomization control system for use in the manufacture of powder with in-situ process control of one or more primary atomization parameters that affect powder size and size distribution.

BACKGROUND OF THE INVENTION

Confined feed (CF) nozzles (also called close-coupled inert gas atomization nozzles), such as annular slit-confined feed and discrete jet-confined feed nozzles (e.g. the high pressure gas atomization HPGA nozzle described in U.S. Pat. No. 5 125 574), are known to be efficient nozzle configurations for producing fine metallic powder by atomizing a suitable melt to form an atomization spray of molten droplets that rapidly solidify to form generally spherical, fine metallic powder. The aforementioned high pressure gas atomization nozzle includes an array of individual gas outlet orifices (jets) located externally of and concentrically to a melt pour tube orifice. Although these nozzles are efficient producers of metallic powder, they require considerable expertise and experience to operate in a commercial production environment in a manner to accommodate various demands of production, such as the need to effect a major shift or change in the mean powder particle size being produced, without having to shut down the powder production operation. Moreover, considerable expertise and experience are required to accommodate major nozzle parameter fluctuations, such as severe transient events including start-up and impending freeze-off of the nozzle, that are experienced without adversely affecting powder production. As a result, the industrial application of such nozzles generally has been limited to a few high technology practitioners, such as producers of nickel base superalloy powder for aircraft gas turbine engines.

The design of most industrial CF atomization nozzles is of the annular slit type and includes a gas outlet in the form of a thin annular slit located externally of and concentric to the melt pour tube orifice. During the typical assembly stage of each atomization run, the annular slit gap, the pour tube position, and the atomization gas pressure, for example, are set according to prescribed parameters based on the experience of the atomization engineer. After the initial settings are made, the engineer does not have the ability to modify the parameters, e.g. slit gap and pour tube position, during the powder production run. Other parameters, e.g. atomization gas pressure, can be varied manually during the run but sometimes not on a sufficiently short time scale to accommodate rapidly occurring/changing transient events or parameters.

Not only do current CF atomization nozzles lack active control devices but also they lack rapid process status sensors. Typically, the atomization process is monitored visually by an operator through a viewport in the side of the spray chamber, primarily to verify that the nozzle is functioning, with, however, the view often being obscured by billowing powders in the spray chamber.

One advancement in feedback sensors for use with powder atomizers; namely, the in-situ particle size analyzer based on scattering of laser light, has been under development for at least six years. This device is intended to determine the as-atomized particle size distribution and provide direct measurement of the effect of a particular set of atomization parameters on particle size. Unfortunately, the data collection and analysis time of this type of laser light scattering device is still minutes and not fractions of a second as required to respond automatically to real atomization parameter fluctuations.

The lack of a fast response time to transient events impedes adequate response and can interfere with or shut off the atomization spray process. Also, the lack of fast response prohibits in-situ tuning of the atomization parameters needed to produce major shifts in mean powder particle size during continuous operation of the atomizing equipment.

It is an object of the present invention to provide an improved gas atomizing apparatus with a control system for providing in-situ control of certain primary nozzle operating parameters to provide enhanced flexibility in the manufacture of powder (e.g. ability to effect a major shift of the desired mean powder particle size) without shut down of the atomization spray process and improved ability to respond to major nozzle parameter fluctuations (e.g. severe transient events such as start-up and impending nozzle freeze-off).

SUMMARY OF THE INVENTION

The present invention provides an improved melt atomizing apparatus comprising atomizing means having melt supply means for supplying hot melt for atomization and gas supply means proximate the melt supply means for supplying atomizing gas to atomize the melt as an atomization spray. The apparatus includes sensor means, such as an optical sensor and/or audio sensor, for providing atomization spray data, and control means responsive to the sensed atomization spray data for controlling one or more atomization parameters that affect powder size and distribution and that can be adjusted to provide rapid in-situ control of the atomization process.

In one embodiment of the invention, the hot melt supply means includes a melt discharge orifice and the gas supply means includes a gas discharge orifice. Actuator means is provided for relatively moving the gas supply means and the melt supply means to vary the relative position of the melt/gas discharge orifices as a primary atomization parameter. Typically, the actuator means is disposed in an atomization chamber for moving the gas supply means relative to the melt supply means.

In another embodiment of the invention, the atomization gas supply means includes a dome loaded (static gas pressure) regulator and the control means comprises a rapid-response gas pressure controller for controlling the dome load on the atomization gas supply regulator so as to thereby control the valve in a manner to vary the pressure of the atomizing gas as a primary atomization parameter.

In still another embodiment of the invention, the control means includes means for storing atomization spray data generated using known relative positions of the gas supply means and the melt supply means and means for comparing the sensed data with the stored data to determine an adjusted relative position of the gas supply means and the melt supply means to achieve a desired atomization spray.

In still a further embodiment of the invention, the control means includes means for storing atomization spray data generated using known atomizing gas pressures and means for comparing the sensed data with the stored data to determine an adjusted atomizing gas pressure to achieve a desired atomization spray.

The present invention also provides an improved method of atomizing a melt to make powder, comprising the steps of supplying the melt for atomization, supplying atomizing gas for atomizing the melt as an atomization spray, sensing the atomization spray to provide atomization spray data, and controlling in response to the atomization spray data at least one of atomizing gas pressure and the relative position of the gas supply means and the melt supply means in a manner to control the atomization spray. The method of the invention includes in one preferred embodiment storing atomization spray data generated using known relative positions of the gas supply means and the melt supply means and comparing the sensed data with the stored data to determine an adjusted relative position of the gas supply means and the melt supply means to achieve the desired atomization spray. Alternately or in addition, atomization spray data generated using known atomizing gas pressures can be stored and the sensed data compared with the stored data to determine an adjusted atomizing gas pressure to achieve a desired atomization spray.

DETAILED DESCRIPTION

Figure 1:
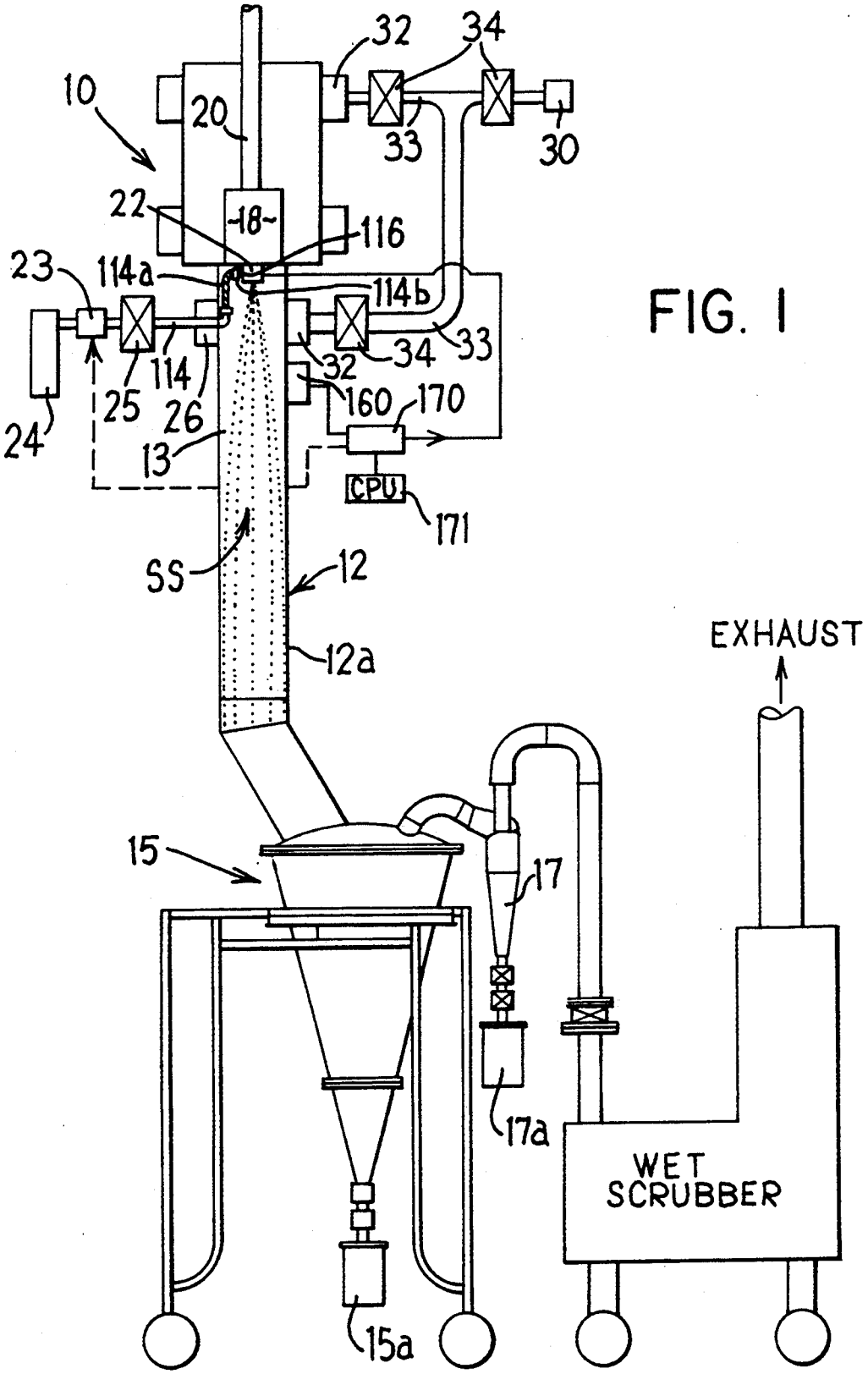
FIG. 1 is a schematic view of a gas atomizing system including an atomizing apparatus in accordance with one embodiment of the invention.

Referring to FIG. 1, a gas atomizing apparatus in accordance with one embodiment of the invention is illustrated as including a melting chamber 10 and a drop tube 12 located beneath the melting chamber 10 and defining a an atomizing chamber 13. The melting chamber 10 includes an induction melting furnace 18 having a melting crucible 18a shown on FIG. 2 and a vertically actuated stopper rod 20 for controlling flow of high temperature melt from the crucible to a melt atomizing nozzle 22 disposed between the furnace and the atomizing chamber. The atomizing nozzle 22 is supplied with an atomizing gas (e.g. argon) from a suitable source 24, such as a conventional bottle or cylinder of the appropriate gas. The atomizing nozzle 22 atomizes the melt (which may be a molten metal or metal alloy or other melt material such as ceramic, polymer and the like) in the form of a supersonic atomization spray SS containing generally spherical, molten droplets of melt discharged into the atomizing chamber 13. The droplets solidify quite rapidly in the atomizing chamber 13 to form fine metallic powder. Although the invention is described with respect to melting the solid starting material in an evacuable/inert gas pressurizable melting chamber 10 and to atomizing the melt into an evacuable/inert gas pressurizable atomizing chamber 13, (e.g. when the melt is prone to air oxidation), the invention is not so limited and can be practiced in air, for example, when the melt is not prone to air oxidation.

Both the melting chamber 10 and the atomizing chamber 13 are connected to an evacuation device (e.g. vacuum pump) 30 via suitable ports 32 and conduits 33. Prior to melting and atomization of the melt, the melting chamber 10 and atomizing chamber 13 are evacuated typically to a level of $10^{-4}$ atmosphere to substantially remove ambient air. Then, the evacuation system is isolated from the chambers 10, 13 via the valves 34 shown and the chambers 10, 13 are positively pressurized by an inert gas (e.g. argon to about 1.1 atmosphere) by conventional inert gas supply system (not shown) to prevent entry of ambient air thereafter.

The drop tube 12 has a generally circular cross-section and typically has a diameter in the range of 1 to 3 feet, a diameter of 1 foot being employed in an exemplary embodiment of the invention. The length of the drop tube can be in the range of 9 to about 16 feet, a length of 10 feet being used in an exemplary embodiment of the invention.

The fine metallic powder is separated from the gas stream and collected in a collector system comprising a primary conical collector 15 having a powder collection container 15*a* and a secondary cyclone collector 17 also having a powder collector container 17*a*. The gas stream then passes through a wet scrubber before being exhausted to the atmosphere. The collector system comprising the primary collector 15 and the secondary collector 17 is described in copending application entitled "POWDER COLLECTION APPARATUS/-METHOD", now U.S. Pat. No. 5 277 705 issued Jan. 11, 1994, of common assignee herewith.

Figure 2:
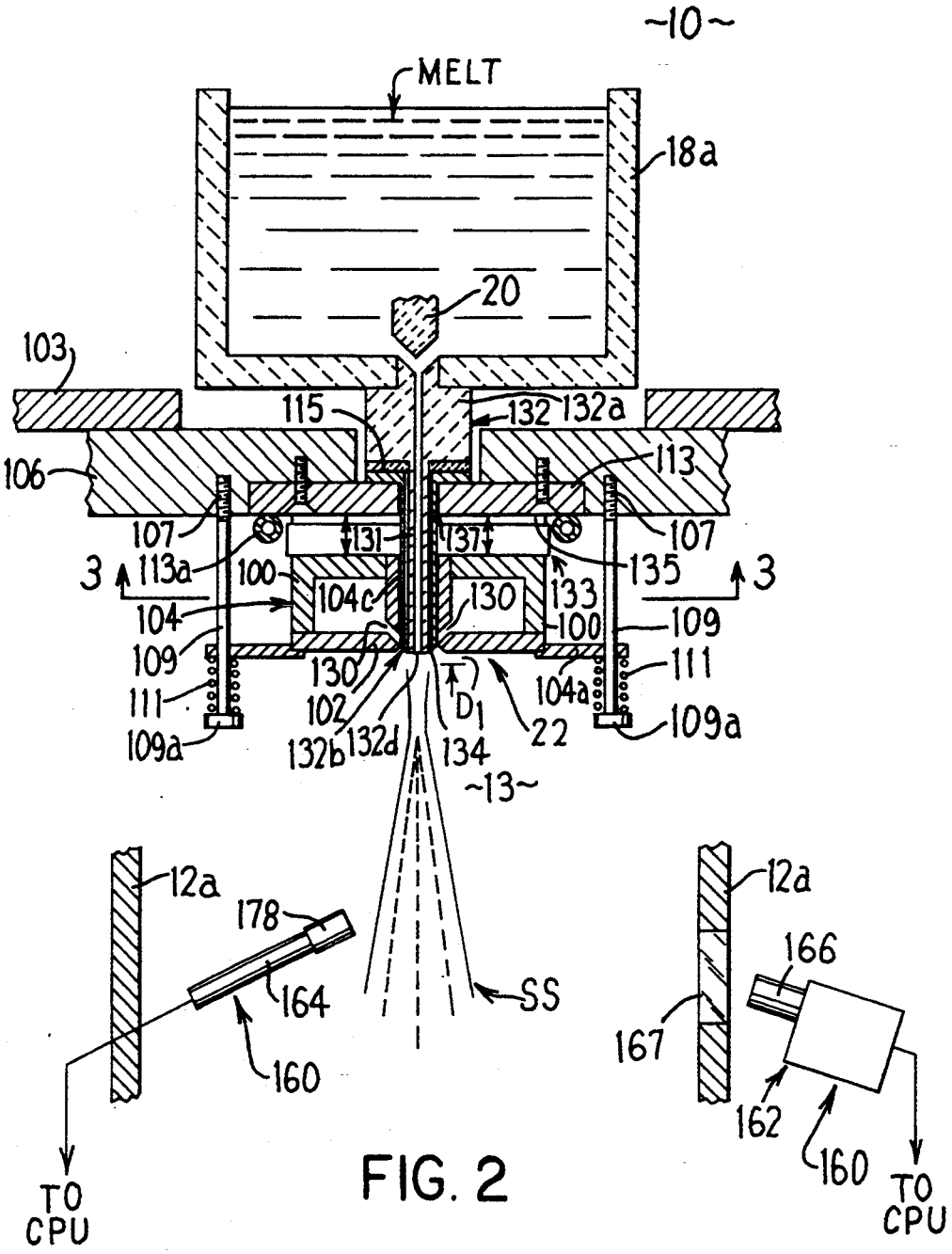
FIG. 2 is a sectioned side elevation of atomizing apparatus in accordance with an embodiment of the invention for practicing a method embodiment of the invention.
Figure 3:
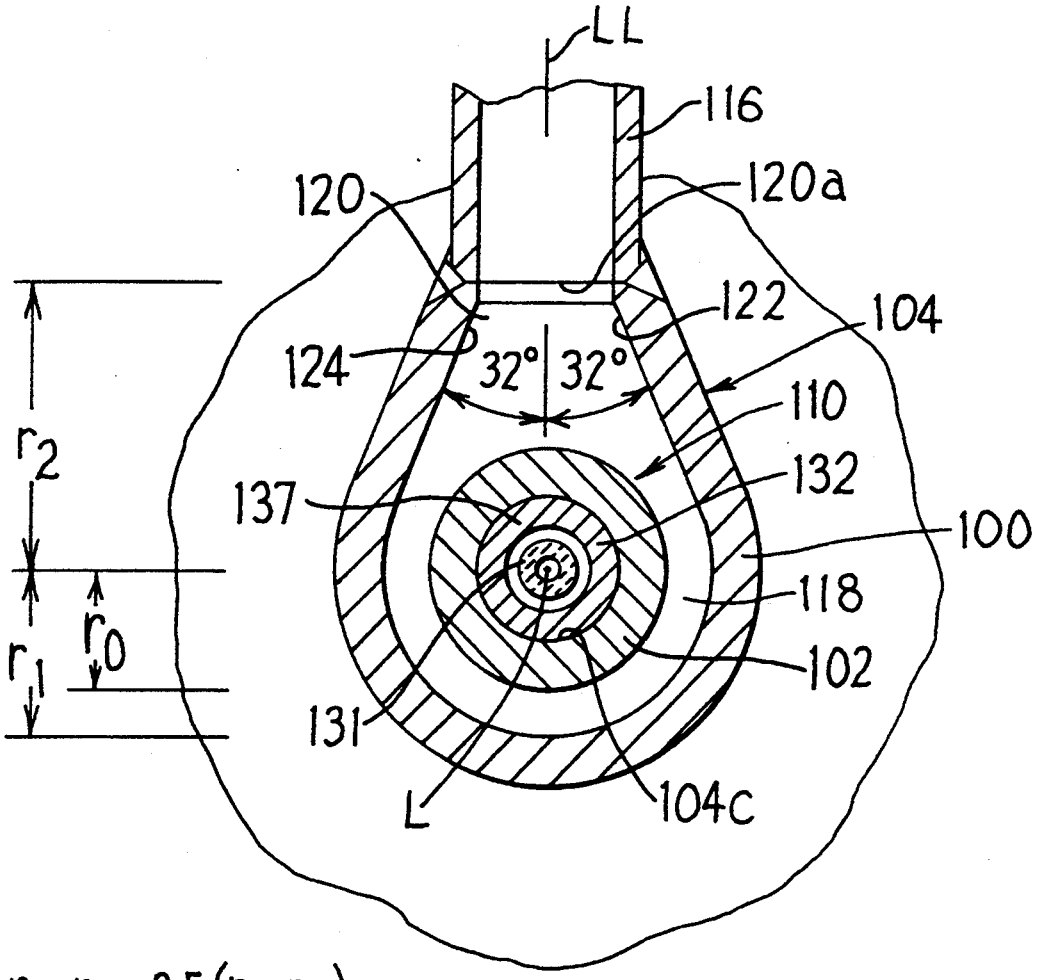
FIG. 3 is a view of the atomizing nozzle taken along lines 3—3.

FIG. 2 illustrates the atomizing nozzle 22 as comprising a first annular nozzle body member 100 and second annular nozzle body member 102 welded together to provide a nozzle body 104 defining gas supply means, such as gas supply manifold 110, FIG. 3. A mounting plate 104*a* is welded to the nozzle body 104.

A large diameter separation/chill plate 106 is disposed above the nozzle body 104 and fastened to the melt chamber bottom plate 103 so as to, in effect, separate the melting chamber 10 from the atomizing chamber 13. The plate 106 includes a plurality of circumferentially spaced screw-receiving holes 107 to receive screws 109 by which the nozzle mounting plate 104*a* is connected to the plate 106 and positioned relative to the bottom of the melting crucible 18*a* about a stationary atomizing nozzle melt supply member or tube 132. The nozzle melt supply tube 132 includes an enlarged cylindrical upper end 132*a* sealingly engaged against the bottom of the melt crucible 18*a* for receiving melt therefrom. The melt supply tube end 132*a* is engaged to the crucible 18*a* by the cooling block member 113 that is fastened to plate 106 by the screws shown. This mounting arrangement is shown best in FIG. 2. The melt supply tube end 132*a* is supported on the cooling block 113 with thermal insulation 115 present as shown. The cooling block is water-cooled by cooling coil 113*a*.

The nozzle body 104 is mounted for vertical movement by springs 111 each disposed about a respective screw 109 between the screw head 109*a* and the mounting plate 104*a*. A lower, smaller diameter end 132*b* of the melt supply tube 132 is received in the bore 104*c* of the nozzle body 104.

The atomizing nozzle melt supply tube end 132*b* comprises an inner ceramic tube 131 and outer metal tube 137 spaced therefrom for heat insulating purposes as shown in U.S. Pat. No. 5 125 574. Insulation 115 provides thermal insulation between the metal tube 137 and ceramic tube 131. The inner refractory melt supply tube 131 may comprise, for example, boron nitride, machinable alumina, or graphite. The metal tube 137 may comprise type 304 stainless steel and is received with clearance (e.g. 0.001 to 0.002 inch) in bore 104*c* to provide an easy sliding fit between the melt supply tube end 132*b* and the nozzle 104. This mounting arrangement of the nozzle body 104 about the nozzle melt supply tube 132 permits vertical movement of the nozzle body 104 (defining gas supply means) relative to the melt supply tube end 132*b* for purposes explained herebelow.

Movement of the nozzle body 104 vertically relative to the melt supply tube end 132*b* is effected by an actuator 133 disposed between the nozzle body 104 and the bottom of the plate member 113 with the movement accurately measured by a transducer (not shown) mounted either within or remote of the actuator 133 and operably associated with the actuator 133 and/or the nozzle body 104.

In one embodiment of the invention, the actuator 133 comprises a "pancake" fluid actuator having a plunger 135 movable in the vertical direction shown by the arrows in FIG. 2; i.e. the plunger can be extended upwardly or retracted downwardly relative to the plate member 113. The actuator 133 can be a conventional hydraulic (e.g. oil) or pneumatic (e.g. gas) actuator available from machine tool suppliers.

Alternate actuators for use in practicing the invention may comprise mechanical screw threaded components (e.g. ball and screw components) coupled to a rotary drive motor (e.g. rotary screw-driving motor), a magnetostrictive crystal (Turfenol-D) driven by an electromagnet or a set of wedge components driven by a larger linear motion actuator driver and having a conventional position sensor (transducer) operably associated with the actuator and/or nozzle body 104. The actuator driver (not shown) can be mounted outside the chamber 13, as well as inside the chamber 13, so long as relative movement between the nozzle 104 and the melt supply tube end 132*b* is provided.

Although the invention is described for illustrative purposes as using the actuator 133 to move the gas supply means (i.e. nozzle body 104) relative to the melt supply means (i.e. melt supply tube end 132*b*), the invention is not so limited and can be practiced using an actuator to move the melt supply means relative to the gas supply means if such an arrangement is advantageous.

The nozzle body 104 defines therein a generally annular gas supply manifold 110 that extends along the vertical, central axis L of the manifold 110, FIG. 3. The gas manifold 110 receives high pressure atomizing gas (e.g. typically argon ) from the source 24, such as a conventional 6000 psi bottle or cylinder of appropriate gas via dome load gas regulator 23, an on/off flow control valve 25, a gas supply conduit 114 containing at least a section of flexible tubing 114*a* (typically comprising a Teflon inner liner and outer stainless steel overbraid), and a gas inlet 116 on the nozzle body 104, FIG. 1. For example, as shown in FIG. 1, the gas supply conduit 114 extends from the valve 25 through a chamber port-26 to the flexible tubing 114*a*. The flexible tubing 114*a* is connected to the rigid nozzle gas inlet conduit 116 by a coupling 114*b* that provides a leak-proof connection.

The dome loaded gas regulator (static gas pressure regulator) 23 comprises an effective means of accurately setting or quickly changing the atomization gas pressure. Such a gas regulator 23 is available from Tescom Corp., Elk River, Minn. The flow rate and pressure of the atomization gas can be controlled by controlling the dome load of such a gas regulator 23.

Disposed between the nozzle gas inlet 116 and a constant cross-section, arcuate manifold segment 118 is a divergent first expansion region or chamber 120, FIG. 3, shaped/dimensioned to function to minimize formation and maximize dissipation of expansion shock waves in the high pressure atomizing gas introduced from gas inlet 116 to the manifold. In particular, the walls 122, 124 of the chamber 120 each diverge at a 32 degree angle relative to the central axis LL of the gas inlet 116. Moreover, the inner and outer radii, $r_0$ and $r_1$, of the arcuate chamber 118 relative to the vertical central axis L of the manifold 110 and the distance $r_2$ of the manifold inlet wall 120*a* relative to the axis L are selected in a particular relationship to this end. For example, generally, $r_0$, $r_1$, and $r_2$ are selected in accordance with the relationship $r_2-r_0 \geqq 2(r_1 \geqq r_0)$, preferably $r_2-r_0$ is approximately equal to $2.5(r_1-r_0)$, as set forth in the Anderson U.S. Pat. No. 5 125 574, the teachings of which are incorporated herein by reference. Example 1 of the Anderson '574 patent sets forth particular dimensions $r_0$, $r_1$, and $r_2$ for the atomizing nozzle 22.

The high pressure atomizing gas flows from the gas supply manifold 110 through a plurality (e.g. 20) of gas jet discharge orifices 130 spaced circumferentially apart about the melt supply member or tube end 132*b* having a central melt discharge orifice 132*d*. The gas discharge orifices 130 define an apex angle that preferably coincides with the apex angle of the frusto-conical surface 134 of the nozzle melt supply tube 135; e.g. 45° as set forth in the aforementioned U.S. Pat. No. 5 125 514 (incorporated by reference).

The size and number of the gas discharge orifices 130 as well as their tangency relative to the central bore 104*c* can be controlled in the manner set forth in the aforementioned U.S. Pat. No. 5 125 574 (incorporated herein by reference) to improve melt atomization.

In accordance with the invention, the atomizing apparatus includes control means responsive to sensed atomization spray data, whether optical, audio, or other data, for controlling one or more primary atomization parameters that affect powder particle size and distribution. For example, at least one of a) the atomizing gas pressure and b) the relative position of the nozzle body 104 (defining gas supply means) and the melt supply tube 132 (defining atomizing nozzle melt supply means) is (are) controllable in a manner to control the atomization spray. In particular, the atomizing gas pressure at the inlet 116 and/or the relative position of nozzle melt supply tube orifice 132*d* and gas jet discharge orifices 130 are controlled to this end.

The atomizing gas pressure is controlled by automated process controller 170, FIG. 1 by controlling the dome loaded regulator 23 of the atomization gas supply while flow control valve 25 is open to allow atomization gas flow to the nozzle 104.

The relative position of the melt supply tube orifice 132d and the gas jet discharge orifices 130 (referred to as the nozzle tip configuration and represented in FIG. 1 by the axial distance D1 between melt supply tube orifice 132*d* and gas jet orifices 130) is controlled by actuator means 133 which is actuated by the automated process controller 170 to move the nozzle body 104 relative to the melt supply tube end 132*b* to vary the relative position of the respective gas and melt discharge orifices 130, 132*d*.

The atomizing apparatus includes rapid response sensor means 160 (shown schematically in FIG. 1) for providing the sensed atomization spray data. In particular, the sensor means 160 observes or analyzes the atomization spray SS discharged from the atomizing nozzle 22 into the atomization chamber 13. Referring to FIG. 2, the sensor means may comprise an optical sensor 162 for optically sensing the atomization spray SS discharged by the nozzle 22 into the atomization chamber 13 and providing eptical atomization spray data. Alternately or in addition, the sensor means may comprise an audio sensor 164 for sensing audio transmissions from the atomization spray SS. Other types of sensors may also be used to this end.

An optical sensor 162 for use in practicing the invention comprises a digital image analysis system (DIAS) that provides digital image data from a video camera 166 which observes the atomization spray SS through a small optical port 167 in the drop tube wall 12*a*. The image from a selected video frame is compared to an ideal atomization spray profile extracted from a library of profiles that have been gathered and analyzed from other atomization reference runs or from verifiable physical modeling experiments and stored in a computer unit (CPU) 171 for like atomization parameters, such as atomizing gas pressure and/or the nozzle tip configuration. The stored ideal image and sensed image are compared by the CPU 171 with the results supplied to the process controller 170 and any recognized deviation from the stored image is analyzed by CPU 171 in terms of known effects of deviations in either atomization gas pressure or nozzle tip configuration on the atomization spray profile or pattern. Based on the detected deviations and the known effects of deviations in gas pressure and/or tip configuration on spray profile, the CPU 171 provides control signals to the process controller 170 to effect corresponding changes or adjustments in one or both of the atomization gas pressure (via regulator 23) and nozzle tip configuration (via actuator 133) to restore the atomization spray SS to the desired conditions represented by the stored image.

An audio sensor 164 for use in practicing the invention may comprise an audiometric signal processor (ASP) that provides digitized audio signals (data) over a broad frequency band; e.g. 1 to 100,000 Hz, by an acoustic microphone 178 located in the atomization chamber 13 in a region near the atomization spray SS. The acoustic signal generated predominantly by the atomization gas, as modified by the hot, dense molten metal droplets, is analyzed by a similar technique as described for the DIAS data. That is, the sensed acoustic image or spectra is compared to an acoustic image or spectra representative of an ideal atomization spray profile extracted from a library of acoustic spectra that have been gathered and analyzed from other atomization reference runs or from verifiable physical modeling experiments and stored in CPU 171 for like atomization parameters, such as atomizing gas pressure and/or axial distance D1 between melt supply tube orifice 132*d* and gas jet orifices 130 (i.e. tip configuration). The stored ideal audio image or spectra and sensed image or spectra are compared by the CPU 171 and any recognized deviation from the stored image is analyzed by CPU 171 in terms of known effects of deviations in either atomization gas pressure or tip configuration on the atomization spray profile or pattern. The CPU 171 provides control signals to the process controller 170 to effect corresponding changes or adjustments in one or both of the atomization gas pressure (via regulator 23) and tip configuration (via actuator 133) to restore the atomization spray SS to the desired conditions represented by the stored image.

Either of the DIAS and ASP sensors 162, 164 can be used singly in conjunction with an automatic process controller 170 and CPU 171 in practicing the invention to provide control of the primary atomization parameters; i.e. atomizing gas pressure (via regulator 23) and tip configuration (via actuator 133). Alternately, the sensors can be combined in a compare and confirm logic mode with a single process controller 170 and CPU 171 to determine the effects of the control actions taken on atomization spray.

The present invention is advantageous in producing ultrafine metallic powder (e.g. mean particle diameter of less than 20 microns) of high purity metals and advanced alloys which are required constituents for solder and braze pastes, metal injection molding, and rapid solidification processing. The invention is also advantageous in that powders for applications such as thermal spraying and rocket propellants requiring larger powder sizes up to a mean particle diameter of, for example, 150 microns can also be produced by the invention by adjusting the atomizing gas pressure and nozzle tip configuration in the manner described above. Insitu control of one or more such primary atomization parameters as atomizing gas pressure and nozzle tip configuration that affect particle size and distribution provides enhanced flexibility in the manufacture of powder; i.e. the ability to shift or change the desired powder particle size without the need to shut down the atomization process. Moreover, improved reliability is imparted to the atomization process in that major nozzle fluctuations can be accommodated; i.e. there is an ability to respond to severe transient events like start-up and impending freeze-off of the nozzle. That is, a response to a process fluctuation by adjusting one or both of the atomizing gas pressure and nozzle tip configuration can produce an immediate beneficial effect on the atomization spray process.

Although the present invention has been described hereabove with respect to the HPGA nozzle, it is not so limited and can be practiced with the aforementioned CF atomization nozzles as well as other CF nozzles such as the ultrasonic gas atomization nozzle (USGA) developed by the Massachusetts Institute of Technology. In particular, the immediate in-situ control of the atomization process primary parameters in accordance with the invention is important to reliable operation of the CF atomizing nozzles where off-normal parameter fluctuations can have a rapid catastrophic effect.

Control of secondary atomization parameters, such as melt superheat and/or melt flow rate, can have beneficial effects on control of the atomization process to augment the benefits provided by in-situ control of the aforementioned primary atomization parameters. However, control of these secondary parameters does not produce benefits in nearly the same time frame (i.e. as rapidly) as in-situ control of the primary parameters described hereabove.

While the invention has been described in terms of specific embodiments thereof, it is not intended to be limited thereto but rather only to the extent set forth in the following claims.

The embodiments of the invention in which an exclusive property or privilege is claimed are defined as follows:

1. Atomizing apparatus, comprising:

atomizing means including melt supply means for supplying melt for atomization, gas supply means disposed about the melt supply means for supplying atomizing gas to atomize the melt as an atomization spray, and actuator means for relatively moving said gas supply means and said melt supply means, sensor means for providing an image of said atomization spray, and control means for controlling said actuator means in response to the sensed image of said atomization spray to adjust the relative position of said gas supply means and said melt supply means in a manner to modify said atomization spray.

2. The apparatus of claim 1 wherein said melt supply means includes a melt discharge orifice and said gas supply means includes a gas discharge orifice and wherein said actuator means moves said gas supply means relative to said melt supply means to vary the relative position of the melt and gas discharge orifices.

3. The apparatus of claim 1 wherein said actuator means is disposed in said atomization chamber to move said gas supply means relative to said melt supply means.

4. The apparatus of claim 1 wherein said control means includes means for storing an image of the atomization spray generated using known relative positions of said gas supply means and said melt supply means and means for comparing the sensed image with the stored image to determine an adjusted relative position of said gas supply means and said melt supply means.

5. The apparatus of claim 4 wherein said sensor means comprises an optical sensor for providing optical image of the atomization spray.

6. The apparatus of claim 4 wherein said sensor means comprises an audio sensor for providing an audio image of the atomization spray.

7. Melt atomizing apparatus, comprising:

atomizing means including melt supply means for supplying melt for atomization and gas supply means disposed about the melt supply means for supplying atomizing gas to atomize the melt as an atomization spray, sensor means for providing an image of said atomization spray, and control means for controlling said gas supply means in response to the sensed image of said atomization spray to adjust the atomizing gas pressure in a manner to modify said atomization spray.

8. The apparatus of claim 7 wherein said gas supply means includes a dome loaded static gas pressure regulator and wherein said control means comprises means for varying the dome load and hence the flow rate and pressure of the atomizing gas.

9. The apparatus of claim 7 wherein said control means includes means for storing an image of the atomization spray generated using known atomizing gas pressures and means for comparing the sensed image with the stored image to determine an adjusted atomizing gas pressure.

10. The apparatus of claim 9 wherein said sensor means comprises an optical sensor for providing an optical image of the atomization spray.

11. The apparatus of claim 9 wherein said sensor means comprises an audio sensor for providing an audio image of the atomization spray.

12. Melt atomizing apparatus, comprising:

atomizing means having melt supply means for supplying melt for atomization, gas supply means disposed about the melt supply means for supplying atomizing gas to atomize the melt as an atomization spray, and actuator means for relatively moving said gas supply means and said melt supply means, sensor means for providing an image of said atomization spray, and control means responsive to the sensed image of said atomization spray for controlling said atomizing gas pressure to adjust the atomizing gas pressure and said actuator means to adjust the relative position of said gas supply means and said melt supply means in a manner to modify said atomization spray.

13. The apparatus of claim 12 wherein said control means includes means for storing an image of said atomization spray generated using known relative positions of said gas supply means and said melt supply means and means for comparing the sensed image with the stored image to determine an adjusted relative position of said gas supply means and said melt supply means.

14. The apparatus of claim 13 wherein said control means includes means for storing an image of said atomization spray generated using known atomizing gas pressures and means for comparing the sensed image with the stored image to determine an adjusted atomizing gas pressure.

* * * * *